US005484191A

United States Patent [19]

Sollami

[11] Patent Number: 5,484,191

[45] Date of Patent: Jan. 16, 1996

[54] INSERT FOR TUNGSTEN CARBIDE TOOL

[75] Inventor: Phillip A. Sollami, Herrin, Ill.

[73] Assignee: The Sollami Company, Herrin, Ill.

[21] Appl. No.: 114,832

[22] Filed: Sep. 2, 1993

[51] Int. Cl.[6] ..... E21B 10/00

[52] U.S. Cl. ..... 299/105; 299/111

[58] Field of Search ..... 175/427, 425, 175/426; 299/86, 79

[56] References Cited

U.S. PATENT DOCUMENTS

| | | | |
|---|---|---|---|
| 2,842,342 | 7/1958 | Haglund | 175/414 |
| 3,361,481 | 1/1968 | Maddock | 299/86 |
| 3,476,438 | 11/1969 | Bower, Jr. | 299/86 |
| 3,746,396 | 7/1973 | Radd | 299/86 |
| 3,833,264 | 9/1974 | Elders | 299/86 |
| 4,176,725 | 12/1979 | Shields | 175/374 |
| 4,854,405 | 8/1989 | Strout | 175/374 |
| 5,131,725 | 7/1992 | Rowlett et al. | 175/427 X |
| 5,324,098 | 6/1994 | Massa et al. | 175/427 X |

*Primary Examiner*—Hoang C. Dang
*Attorney, Agent, or Firm*—Patnaude, Videbeck & Marsh

[57] ABSTRACT

Tungsten carbide inserts which are the cutting tips of a rotating excavating tool have a forwardmost cutting end and an intermediate cutting surface which are formed of tungsten carbide alloys having different degrees of hardness. In a preferred embodiment of the invention, the center of each insert is formed of a harder tungsten carbide material than is the outer cutting portion located rearwardly of the harder center portion. In another embodiment of the invention, the intermediate cutting section comprises a plurality of longitudinally extending buttresses which break up the material being excavated as the insert penetrates the material.

18 Claims, 4 Drawing Sheets

INSERT FOR TUNGSTEN CARBIDE TOOL

The present invention relates in general to tool inserts for use in machines which break up road surfaces such as concrete and asphalt as well being used in underground mining such as coal, trona, potash and salt, and it relates in particular to a new and improved insert which incorporates a plurality of buttresses in a unitary tip or insert which may be formed of carbide materials having different degrees of hardness.

BACKGROUND OF THE INVENTION

One type of machine which is used to break up pavements and other hard surfaces utilizes a plurality of tungsten carbide tools which are carried by a motor driven rotatable cutting wheel and forced against the surface to be excavated. The individual tools include a steel body in which a tungsten carbide insert is rotatably mounted. As the cutting wheel rotates, the tools are carried through a circular orbit such that the distal ends of the tungsten carbide inserts strike and penetrate the surface to be cut. Each tool thus removes a small amount of the surface material as the cutting wheel rotates and successively forces the tools into the surface being excavated.

The bodies of the cutting tools are commonly formed of steel and are rotatably connected to the respective inserts by complementary, interengaging portions of the body and inserts. In some tool designs a socket is provided in the front end of the body to receive the rear end of the insert, while in other tool designs the rear end of the insert is provided with a socket which receives a forwardly extending portion of the body.

In the prior inserts, the forward ends which cut into the surface to be excavated are generally either conical or semispherical and are disposed forwardly of a base portion which is secured to the body of the tool. Such inserts are relatively small having an overall length of about one-half inch and a maximum diameter of about five-eighths of an inch. Because of the large numbers of inserts which are used in a typical excavating machine, it is very important that each insert have a long useful life and neither crack or wear unduly during normal use.

It would be desirable to provide an insert for a cutting tool which could be made of a hard, yet brittle substance, such as tungsten carbide, but which does not crack during normal use and which has a reduced cross sectional area along the length of the cutting portion so as to reduce the amount of energy required to force the insert into the surface being excavated. Furthermore, because the cost of manufacturing such tools is high, a substantial part of that cost being the tungsten carbide itself, another benefit of an insert of reduced cross sectional area is a reduction in the cost of manufacturing the insert. Also, the buttresses aid the tool in rotating which provides even wear around the tip of the tool.

SUMMARY OF THE INVENTION

Briefly, there is provided in accordance with one aspect of the present invention a unitary tungsten carbide insert having a forwardmost cutting end and an intermediate cutting surface which are formed of tungsten carbide alloys having different degrees of hardness. In a preferred embodiment of the invention the center of the insert is formed of a harder tungsten carbide material than is the outer cutting portion located rearwardly of the harder center portion.

In accordance with another aspect of the invention a unitary tungsten carbide insert has a base for mounting the insert to the body of the tool, a forward cutting end which initially penetrates the surface to be excavated, and an intermediate cutting section which comprises a plurality of longitudinally extending buttresses which break up the material being excavated as the insert penetrates the material and is rotated therein by the torque which is exerted thereon by the rotating cutting wheel and the material which is penetrated by the insert.

Inserts for use in breaking up concrete have relatively small internal corners adjacent the buttresses to minimize the amount of tungsten carbide used in the insert. However, inserts designed for use in excavating softer materials such as asphalt have fillets between the buttresses and the base to guide the excavated material past the buttresses and away from the insert.

GENERAL DESCRIPTION OF THE DRAWINGS

A better and more complete understanding of the present invention will be had from a reading of the following detailed description taken in conjunction with the accompanying drawings wherein.

DETAILED DESCRIPTION OF A PREFERRED EMBODIMENT

Figure 1:
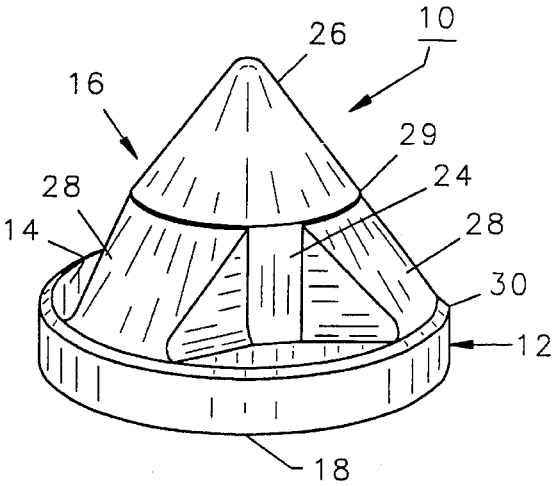
FIG. 1 is an isometric view of an insert embodying the present invention.
Figure 2:
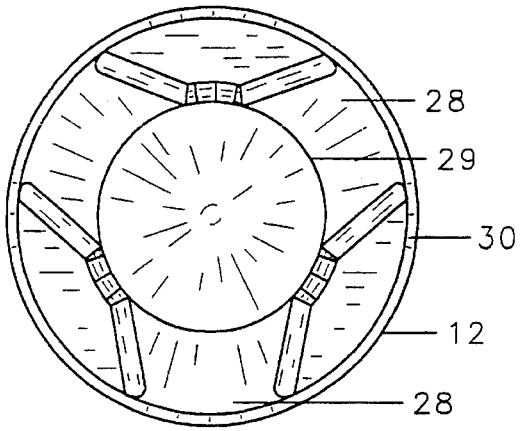
FIG. 2 is a top view of the insert shown in FIG. 1.
Figure 3:
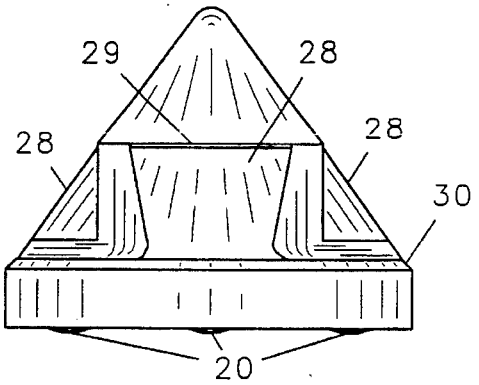
FIG. 3 is an elevational view of the insert shown in FIG. 1.

Referring to FIGS. 1–4 an insert 10 constructed in accordance with the present invention has a generally cylindrical base 12 having a diameter suitable for being received within a complementary socket in the body of a cutting tool (not shown). The base 12 has a generally planar front side 14 which lies perpendicular to the longitudinal axis of the associated cutting tool and from which extends the cutting portions 16 of the insert, and a generally circular rear face 18. The rear face 18 preferably has a plurality of spaced protrusions or dimples 20 which spaces the rear face 18 from the bottom of the associated socket to facilitate brazing of the insert to the body of the tool.

Extending perpendicularly from the center portion of the face 14 is a column 24 having a conically shaped cutting end 26. Extending from the central column 24 are three angularly spaced buttresses 28 which respectively extend forwardly from the base 12 to the rear edge 29 of the conical penetrating end 26. Suitable fillets are provided at the adjoining edges of the buttresses 28, the base 12, and the column 24 for improved strength. The forward edge 30 of the base 12 is chamferred, and it will be seen from an inspection of FIG. 3 that the buttresses 28 and the tip 26 together with the chamfer at 30 have a generally conical profile for efficient penetration of the surface to be excavated.

While the tip 26 is conical in the insert 10, it will be understood that for some applications it may be preferable for the distal end of the tip to be of some other configuration, such, for example, as semispherical.

Also, for some applications it is preferable that the tip 26 be formed of a harder grade of tungsten carbide than that of which the buttresses 28 are formed. Moreover, the buttresses may be of a different configuration depending upon the nature of the material to be excavated.

Figure 5:
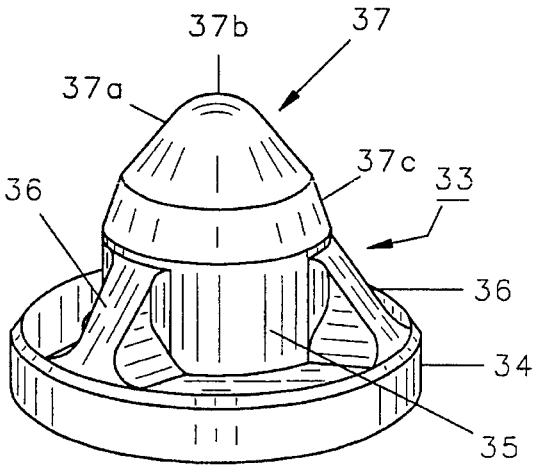
FIG. 5 is an isometric view of another insert constructed in accordance with another embodiment of the invention.
Figure 4:
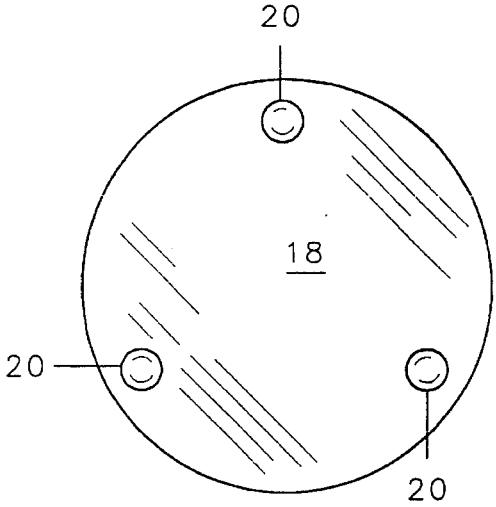
FIG. 4 is a bottom view of the insert shown in FIG. 1.

Referring to FIG. 5, wherein an insert includes a base 34, a central column 35, a plurality of angularly spaced buttresses 36, and a cutting tip 37. The cutting tip has a generally conical front end 37*a* having a semispherical end 37*b* and a frustoconical section 37*c*. The sharper front end provides better initial penetration while the less sharp section 37*c* improves the strength of the insert. In this embodiment of the invention the buttresses are thinner than are the buttresses 28 in the insert 10 shown in FIG. 1. In other respects the inserts 10 and 33 are the same.

Figure 6:
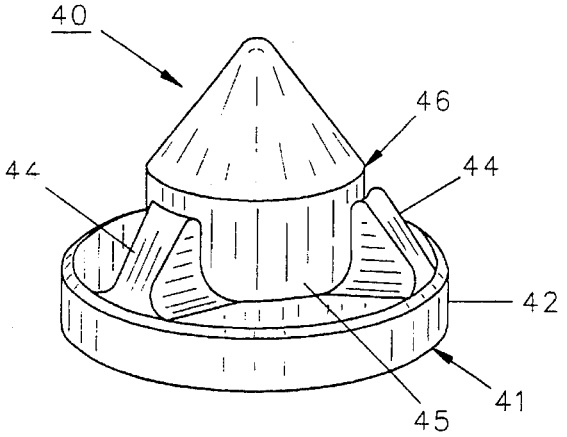
FIG. 6 is an isometric view of still another insert embodying the present invention.
Figure 7:
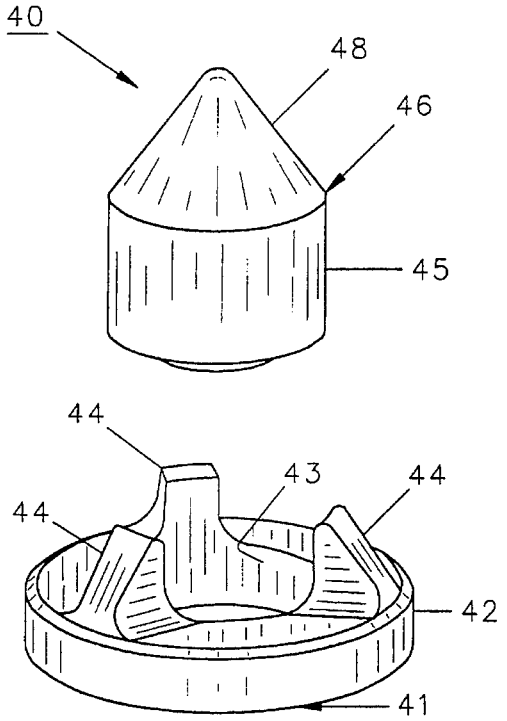
FIG. 7 is an exploded isometric view of the insert shown in FIG. 6.
Figure 8:
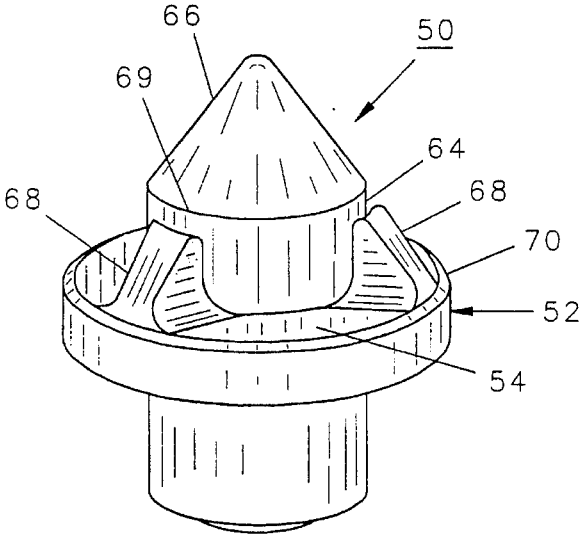
FIG. 8 is an isometric view of yet another insert embodying the present invention.

Referring to FIGS. 6 and 7, there is shown another embodiment of the invention wherein an insert 40 includes a first part 41 provided with a generally cylindrical base 42 having a central bore 43 extending therethrough and a plurality of buttresses 44 extending forwardly therefrom. The buttresses are generally triangular when viewed from the side and each has an arcuate inner edge for receiving the cylindrical base portion 45 of a tip member 46 when the parts 41 and 46 are assembled. The tip member has a conical forward penetrating end surface 48, but other configurations may be provided depending upon the nature of the material to be excavated.

The tip member 46 is formed of a harder grade of tungsten carbide than is the part 41. When the parts 41 and 46 are brazed together to form a unitary insert, the softer grade of tungsten carbide used in the part 41 provides greater resistance to sheer forces which tend to break the buttresses while the harder grade of tungsten carbide used in the tip provides improved penetration of the surface being excavated.

In other respects the insert 40 is the same as the insert 33. It will be understood that additional or fewer buttresses may be used if desired in any of the embodiments described herein.

Referring to FIGS. 8–11, an insert 50 constructed in accordance with the present invention has a generally cylindrical base 52 having a diameter suitable for being received within a complementary socket in the body of a cutting tool (not shown). The base 52 has a generally planar front side 54 which lies perpendicular to the longitudinal axis of the associated cutting tool and from which extends the cutting portions of the insert, and a rear annular face 58. The rear face 58 preferably has a plurality of angularly spaced protrusions or dimples 60 which spaces the rear face 58 from the bottom of the associated socket to facilitate brazing of the insert to the body of the tool.

Extending perpendicularly from the center portion of the face 54 is a column 64 having a conically shaped penetrating end 66 and a rearward portion which extends rearwardly through the center of the base 52 for receipt in a complimentary socket of an associated cutting tool body. The rear edge of the column 64 is chamferred as shown at 67. Extending laterally from the central column 64 are three angularly spaced buttresses 68 which respectively extend forwardly from the base 52 to the rear edge 69 of the conical penetrating end 66. Suitable fillets are provided at the adjoining edges of the buttresses 68, the base 52 and the central column 64 for improved strength. If desired, the fillet between the column 64 and the base 52 may be omitted. The forward edge 70 of the base 52 is chamferred, and it will be seen from an inspection of FIG. 10 that the buttresses 68 and the tip 66 together with the chamfer at 70 have a generally conical profile for efficient penetration of the surface to be excavated.

While the tip 66 is conical in the insert 50, it will be understood that for some applications it may be preferable for the distal end of the tip to be of some other configuration, such, for example, as semispherical.

Also, for some applications it is preferable that the tip 66 be formed of a harder grade of tungsten carbide than that of which the buttresses 68 are formed. Accordingly, the entire member 50 when made from two separate pieces may be formed of a harder grade of tungsten carbide than is the base and buttress portions of the insert. Moreover, the buttresses may have a different configuration depending upon the nature of the material to be excavated.

Figure 12:
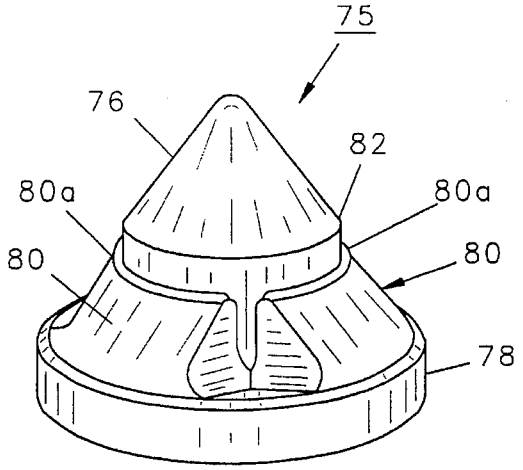
FIG. 12 is an isometric view of another insert embodying the present invention.
Figure 9:
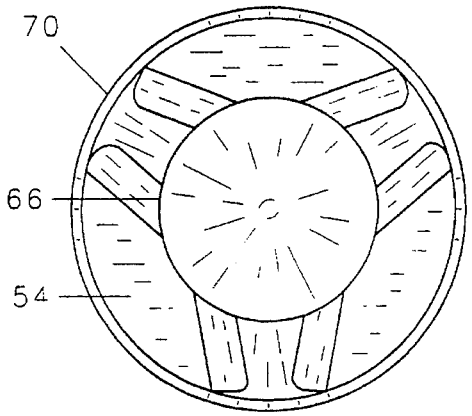
FIG. 9 is top view of the insert shown in FIG. 8.
Figure 10:
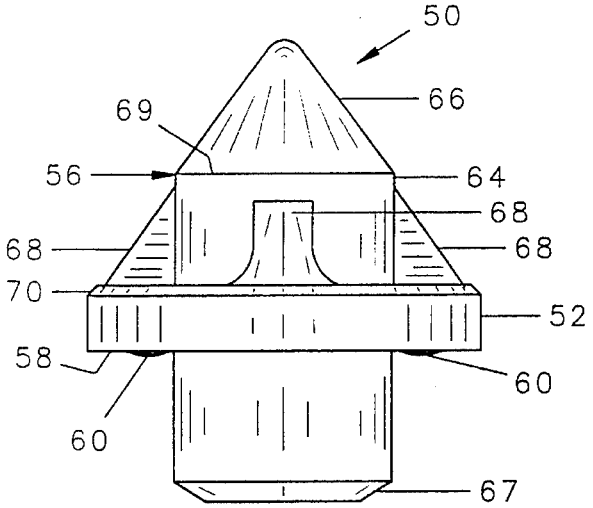
FIG. 10 is an elevational view of the insert shown in FIG. 8.
Figure 11:
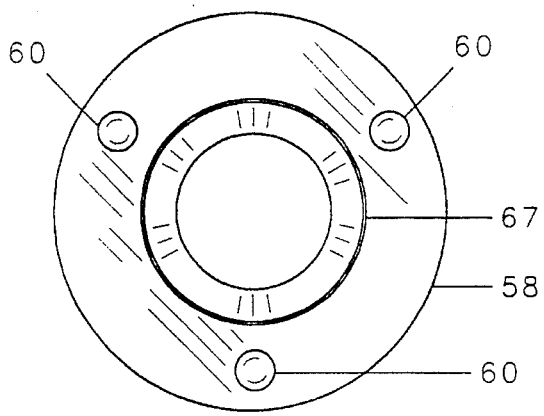
FIG. 11 is a bottom of the insert shown in FIG. 8.

Referring to FIG. 12, there is shown an insert 75 having a penetrating tip 76 which is conical in shape, a base 78 which is generally cylindrical, and a plurality of angular spaced buttresses 80 having a combined external profile which is generally frustoconical and has an angle of taper the same as that of the tip 76. The buttresses have a substantially greater angular length than those shown in the earlier described embodiments of the invention. The buttresses 80 are provided with arcuate upper faces 80*a* which are spaced rearwardly from the annular rear edge 82 of the penetrating tip 76. If desired, the tip may be formed from a harder grade of tungsten carbide than the rest of the insert. As in the other inserts having a softer body and a harder tip, the insert is less likely to break during use because of the greater strength of the buttresses to support the hard penetrating tip.

Figure 14:
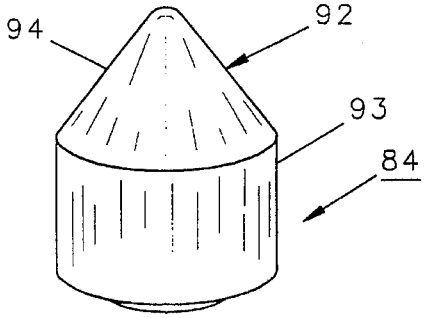
FIG. 14 is an exploded isometric view of the insert shown in FIG. 13.
Figure 14:
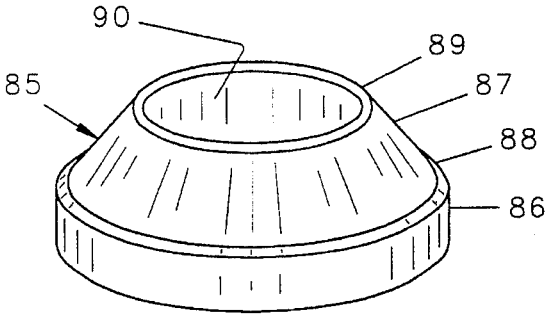
Figure 13:
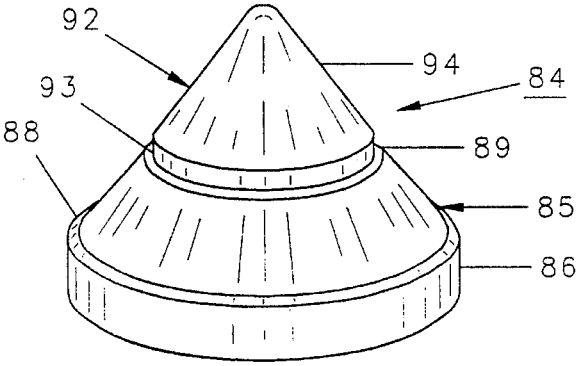
FIG. 13 is an isometric view of still another insert embodying the present invention.

Referring to FIGS. 13 and 14 there is shown an insert 84 having a first part 85 having a cylindrical base 86 and a frustoconical intermediate section 87 joined to the base section 86 by an annular chamfer 88. The intermediate section 87 has a planar annular forward end 89 which surrounds a cylindrical bore 90 which extends through the entire part 85 along the longitudinal axis thereof.

The insert 84 also includes a second part 92 which has a cylindrical body section 93 which is substantially complementary to the bore 90 in the part 85 and a forward conical cutting surface 94 which is adapted to penetrate the material to be broken up. The parts 85 and 92 are brazed together to provide a unitary insert as shown in FIG. 13.

Inasmuch as the forward part 92 must withstand a greater compressive force than the part 85, the forward part 92 is formed of a harder grade of tungsten carbide than is the rearward part 85. In formulating the harder grade of tungsten carbide a smaller grain structure is provided which increases the compressive strength of the forward part of the insert which enables the use of increased rotational speeds of the insert without breakage of the insert. The hardness of the part 85 will be in the range of Ra85 to Ra89 while the hardness of the part 92 will be in the range of Ra87 to Ra92. It is believed that the difference in hardness between the parts 85 and 92 should be no less than about Ra5. Also, by using two different degrees of hardness for the parts 85 and 92 the height of the conical cutting surface can be reduced and still produce adequate penetration of the material to be broken up. I have found that the insert can be designed so that the height of the cutting section can be adjusted to match the hardness of the material being broken up.

Figure 15:
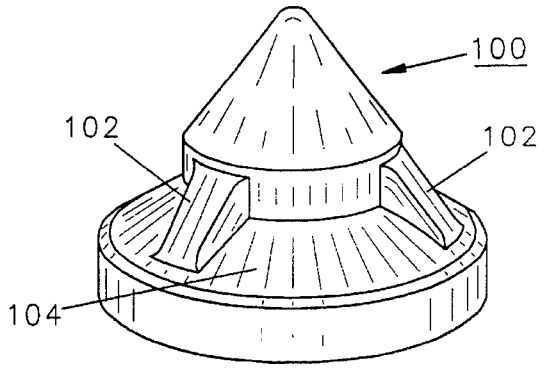
FIG. 15 is an isometric view of another insert embodying the present invention.

Referring to FIG. 15 there is shown an insert 100 which is similar to the insert 10 shown in FIG. 1, but wherein the buttresses 102 are narrower than the buttresses 28 and wherein the upper or forward face 104 slopes away from the longitudinal axis of the insert to direct particles from the surface being broken up away from the insert to facilitate the removal thereof from the tool. Fillets may be used at the interface surfaces 104 and the buttresses 102 as well as at the interfaces between the surfaces 104 and the central column.

Figure 16:
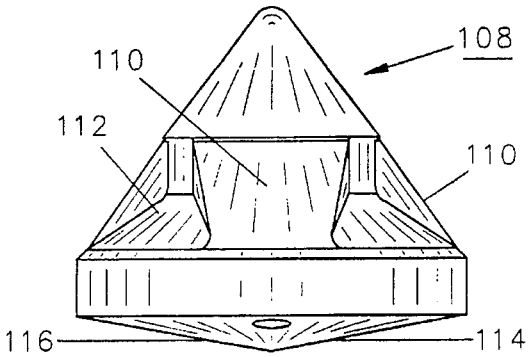
FIG. 16 is an elevational view of another inert embodying the present invention.
Figure 17:
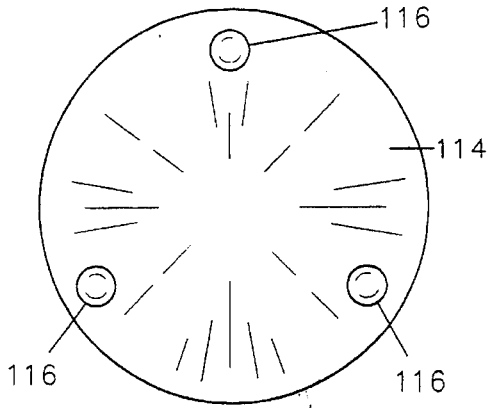
FIG. 17 is a bottom view of the insert shown in FIG. 16.

Referring to FIGS. 16 and 17 there is shown an insert 108 which is similar to the insert 100 shown in FIG. 16 but wherein the buttresses 110 are wider, the front face 112 of the base has a greater angle of slope than does the face 104, and wherein the rear face 114 of the base is conical for receipt in a conical socket in the associated tool body. A plurality of spaced protuberances 116 extend a short distance from the surface 114 to space the surface 114 from the opposing face of the socket in the tool body to permit brazing material to flow between the insert and the tool body when the parts are affixed to form a unitary part.

Figure 18:
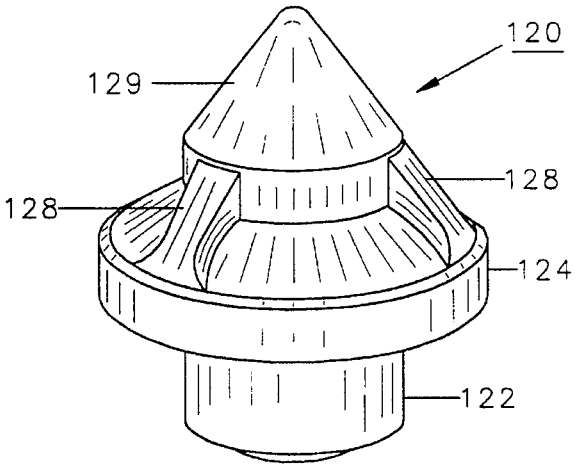
FIG. 18 is an isometric view of still another insert embodying the present invention.

Referring to FIG. 18, an insert 120 is similar to the insert 100 shown in FIG. 1 but includes a depending, centrally located cylindrical post 22 which depends from the cylindrical base 124 of the insert. Where desired, the past and the conical tip may be formed of a first material and the base 124 including a plurality of integral buttresses 128 formed of another material when a two-piece design is used. Both materials are preferably tungsten carbide with the tip and post being formed of a harder grade of tungsten than that used in the base.

Figure 19:
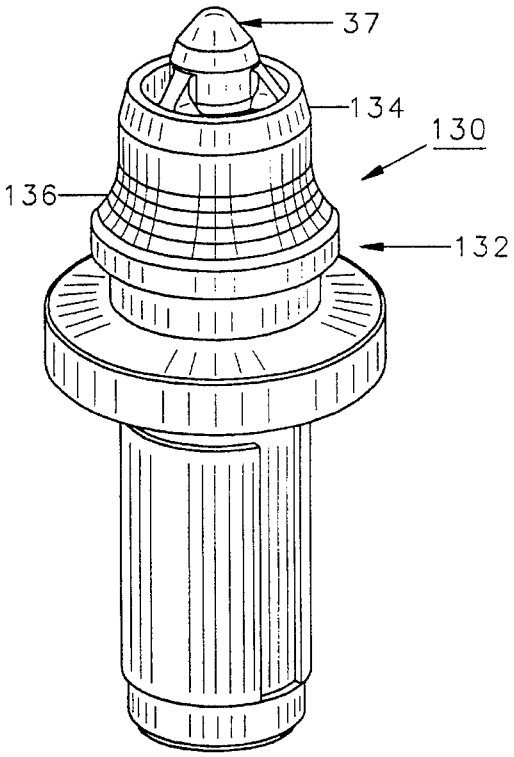
FIG. 19 is an isometric view of an insert and tool body assembly embodying the present invention.

Referring to FIG. 19, a tool body and insert assembly 130 includes a tool body 132 having a cylindrical socket at the upper or forward end in which is positioned an insert 37 which is described in greater detail in connection with FIG. 5. The tool body 132 is made of a suitable metal such as alloy steel and has a rearwardly diverging frustoconical surface 134 at the forward end and an annular fillet 136 spaced therefrom to direct particles of the material being excavated away from the tool body.

Figure 20:
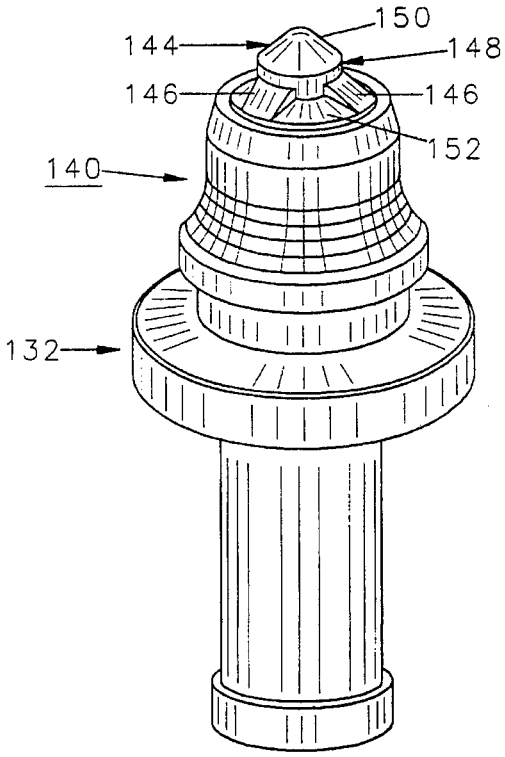
FIG. 20 is an isometric view of still another insert and tool body assembly embodying the present invention.

FIG. 20 shows an assembly 140 of the tool holder 132 shown in FIG. 19 and an insert 144 formed of tungsten carbide and having a plurality of buttresses 146 extending radially from a central post like member 148 having a generally conical tip and a cylindrical body portion which adjoins the tip a short distance forwardly of the front ends of the buttresses 146 along the plane 150. As may seen in the drawing, the front face 152 of the base of the insert is sloped away from the post 148.

While the present invention has been described in connection with a plurality of embodiments thereof, it will be understood that many changes and modifications thereof may be made without departing from the true spirit and scope of the invention, and it is intended by the appended claims to cover all such changes and modifications which come within the true spirit and scope of the present invention.

What is claimed:

1. 1. An insert formed of tungsten carbide for a cutting tool, comprising in combination a base having a first side and a second side, a peripheral edge bordering on said first side, and said second side having a shape adapted to be secured to said cutting tool, a column centrally located on said first side and extending perpendicularly thereto along the longitudinal axis of said insert, said column having a cutting surface at the end thereof remote from said base, a plurality of buttresses extending radially from said column between said base and said column, and said cutting surface being formed of a harder grade of tungsten carbide than that of which said base is formed.

2. An insert according to claim 1 wherein said cutting surface is conical.

3. An insert according to claim 1 wherein said column has an intermediate section located between said base and said cutting surface which is frustoconical.

4. An insert according to claim 1 wherein said buttresses have a planar outer surface.

5. An insert according to claim 1 wherein said buttresses extend to the periphery of said base.

6. An insert according to claim 1 wherein said column is formed of a harder grade of tungsten carbine than that of which said base is formed.

7. An insert according to claim 1 wherein said buttresses have planar sides extending outwardly from said column.

8. An insert for a cutting tool, comprising in combination a first member adapted to be secured to said cutting tool, said first member comprises a base and a forwardly extending central section having a plurality of angularly spaced, radially extending buttresses, a second member secured to said first member and extending forwardly therefrom, said second member having a cutting surface disposed at the forward end thereof, said first and second members being formed of tungsten carbides, and the tungsten carbide from which said first member is formed being of a different degree of hardness than that from which said second member is formed.

9. An insert according to claim 8 wherein said first member is softer than said second member.

10. An insert according to claim 9 wherein said first member has a bore therein, and said second member is fitted in said bore and secured to said first member to form a unitary insert.

11. An insert according to claim 8 wherein said central section is joined to said base by a plurality of fillets for directing material excavated by said cutting surfaces away from said base.

12. An insert according to claim 11 wherein said buttresses are joined to said base by a plutality of fillets located at the sides of said buttresses for directing material excavated by said cutting surfaces away from said base.

13. An insert according to claim 8, wherein said cutting surface is generally conical.

14. An insert according to claim 8, wherein said cutting surface is hemispherical.

15. An insert for use in a rotatable cutting tool, comprising in combination a base having a rear end portion adapted to be secured to said cutting tool, an intermediate section extending forwardly from said base, a cutting surface being formed of tungsten carbide and disposed forwardly of said intermediate section, said intermediate section including a plurality of angularly spaced buttresses extending in a radial direction and being integral with said base, said intermediate section having a frustoconical section disposed adjacent to said cutting surface and forwardly of said buttresses, and, said base being formed of a grade of tungsten carbide which is different from the grade of tungsten carbide of which said cutting surface is formed.

16. An insert according to claim 15 wherein said cutting surface is harder than said base.

17. An insert according to claim 15 wherein a forward side of said base is frustoconical.

18. An insert formed of tungsten carbide for a cutting tool, comprising in combination a base having a first side and a second side, a peripheral edge bordering on said first side, and said second side having a shape adapted to be secured to said cutting tool, a column centrally located on said first side and extending perpendicularly thereto along the longitudinal axis of said insert, said column having a cutting surface at the end thereof remote from said base, a plurality of buttresses extending radially from said column between said base and said column, and said cutting surface being formed of a different grade of tungsten carbide than that of which said base is formed.

* * * * *